US008266751B2

(12) United States Patent
He

(10) Patent No.: US 8,266,751 B2
(45) Date of Patent: Sep. 18, 2012

(54) METHOD TO COMPRESS PREFABRICATED DECK UNITS BY TENSIONING SUPPORTING GIRDERS

(76) Inventor: Yidong He, Naperville, IL (US)

( * ) Notice: Subject to any disclaimer, the term of this patent is extended or adjusted under 35 U.S.C. 154(b) by 7 days.

(21) Appl. No.: 12/963,233

(22) Filed: Dec. 8, 2010

(65) Prior Publication Data

US 2011/0138549 A1 Jun. 16, 2011

Related U.S. Application Data

(60) Provisional application No. 61/285,507, filed on Dec. 10, 2009.

(51) Int. Cl.
*E01D 21/00* (2006.01)

(52) U.S. Cl. ..... 14/77.1; 14/73; 14/74.5; 14/77.3; 14/78; 52/745.2

(58) Field of Classification Search ..... 14/73.1, 14/74.5, 77.1, 73–78
See application file for complete search history.

(56) References Cited

U.S. PATENT DOCUMENTS

| | | | | |
|---|---|---|---|---|
| 3,676,968 | A * | 7/1972 | Campbell | 52/223.6 |
| 5,437,072 | A * | 8/1995 | Dinis et al. | 14/73 |
| 5,457,839 | A | 10/1995 | Csagoly | |
| 6,065,257 | A * | 5/2000 | Nacey et al. | 52/223.8 |
| 6,265,257 | B1 * | 7/2001 | Hsu et al. | 438/215 |
| 6,345,403 | B1 * | 2/2002 | Nagle | 14/77.1 |
| 6,470,524 | B1 * | 10/2002 | Mairantz | 14/77.1 |
| 6,588,160 | B1 | 7/2003 | Grossman | |
| 6,668,412 | B1 | 12/2003 | Tadros et al. | |
| 6,857,156 | B1 * | 2/2005 | Grossman | 14/73 |
| 7,197,854 | B2 * | 4/2007 | Bettigole et al. | 52/414 |
| 7,373,683 | B2 | 5/2008 | Moon | |
| 7,421,825 | B2 * | 9/2008 | Skendži et al. | 52/223.8 |
| 7,461,427 | B2 | 12/2008 | Ronald et al. | |
| 7,475,446 | B1 | 1/2009 | He | |
| 7,600,283 | B2 | 10/2009 | Nelson | |
| 8,020,235 | B2 * | 9/2011 | Grace | 14/74.5 |
| 2002/0083659 | A1 * | 7/2002 | Sorkin | 52/167.1 |
| 2003/0182883 | A1 * | 10/2003 | Won | 52/223.8 |
| 2008/0209646 | A1 | 9/2008 | Abardia Garcia | |
| 2011/0099941 | A1 * | 5/2011 | Yegge | 52/831 |

OTHER PUBLICATIONS

Badie and Tadros, Full-Depth Precast Concrete Bridge Deck Panel Systems, NCHRP Report584, 2008, Transportation Research Board, 500 Fifth Street, NW, Washington, DC 20001. related information: chapter 2.

Full Depth Precast Concrete Deck Panel Manual, Utah Department of Transportations. May 2009.

Sullivan, Construction and Behavior of Precast Bridge Deck Panel Systems, PhD. Dissertation, Apr. 2007, Virginia Polytechnic Institute and State University. Blacksburg, Virginia.

Culmo, Connection Details for Prefabricated Bridge Elements and Systems. Publication # FHWA-IF-09-010, Federal Highway Administration, US Department of Transportation, Mar. 30, 2009. related information: article 2.2.1 Full Depth Precast Concrete Deck Slabs.

* cited by examiner

*Primary Examiner* — Raymond W Addie

(57) ABSTRACT

A structural system comprised of prefabricated deck units spaced along longitudinal load-carrying members, which produce longitudinal axial compression in deck units by tensioning the longitudinal load-carrying members without the use of standard post-tensioning details. During construction, prefabricated deck units are erected on top of and supported by the longitudinal load-carrying members via leveling devices, which also permit relative motion between the longitudinal load-carrying members and the prefabricated deck units. Jacking apparatuses are used to introduce deck compression by jacking against the longitudinal load-carrying members. This system can be used for new structures and for deck replacement of existing structures.

12 Claims, 7 Drawing Sheets

M-M

N-N

METHOD TO COMPRESS PREFABRICATED DECK UNITS BY TENSIONING SUPPORTING GIRDERS

CROSS-REFERENCE TO RELATED APPLICATIONS

This application claims the benefit of U.S. Provisional Application No. 61/285,507, filed Dec. 10, 2009 by the present inventor.

FEDERALLY SPONSORED RESEARCH

Not Applicable

SEQUENCE LISTING OR PROGRAM

Not Applicable

BACKGROUND OF THE INVENTION

1. Field of Invention

This invention relates to the design and construction of structures, specifically to structures with prefabricated deck units.

2. Prior Art

Full-depth precast concrete deck has gained popularity as an accelerated construction method. Use of full-depth precast concrete deck allows for the deck concrete and reinforcement to be placed in a controlled environment, improving the quality of the deck. Since the units are prefabricated, they can be delivered to a site and erected quickly.

Structures using full-depth precast concrete deck typically consist of a plurality of longitudinally spaced concrete deck units supported by longitudinal load-carrying members. This member or members is usually a single girder or multiple girders.

This member or members can be comprised of various materials including steel, concrete, wood or fiber-reinforced plastic.

To improve deck durability, it is important to have a pre-compression force across deck joints to minimize the propensity of the deck to crack under loading. Currently, such pre-compression force is supplied via standard post-tensioning systems, which utilize post-tensioning tendons or bars within ducts. US Federal Highway Administration technical report (#FHWA-IF-09-010) provides a comprehensive summary of current engineering practice using precast deck units, showing that all current precast deck systems with longitudinal compression utilize post-tensioning systems in the deck. Other patent references, such as U.S. Pat. Nos. 7,475,446, 7,461,427, and 5,457,839, illustrate various methods of using post-tensioning system to provide deck compression. However, using standard post-tensioning details carries with it the disadvantage of requiring additional cost and time to construct. This invention provides a more economical solution. The pre-compression force across deck joint is produced not by post-tensioning tendons but by tensioning the supporting girders themselves.

OBJECTS AND ADVANTAGES

Accordingly, several objects and advantages of the present invention are to provide a structural system that:

a. facilitates rapid construction of a structure consisting of prefabricated deck units, wherein increasingly tight construction schedules and/or site constraints can be accommodated;

b. provides pre-compression across joints between deck units to improve deck durability by tensioning the bridge girder;

c. typically increases the overall load resistance of the structure by tensioning the girder, whereby significantly reducing the amount of material required in the girders;

d. eliminates the need for standard post-tensioning details, whereby reducing the cost and time of construction.

Further objects and advantages will become apparent from a consideration of the ensuing description and drawings.

SUMMARY

In accordance with the present invention a structural construction system comprises prefabricated deck units spaced along longitudinal load-carrying members. Axial compression of these prefabricated deck units is produced by various means to react against the longitudinal load-carrying members.

DRAWINGS—FIGURES

DRAWINGS—REFERENCE NUMERALS

Figure 1:
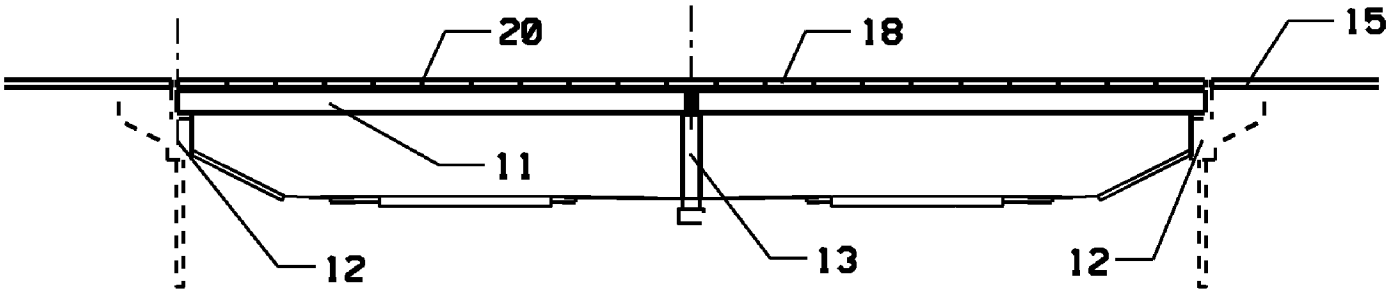
FIG. 1 shows the elevation view of an example bridge used to describe the present invention.
Figure 2:
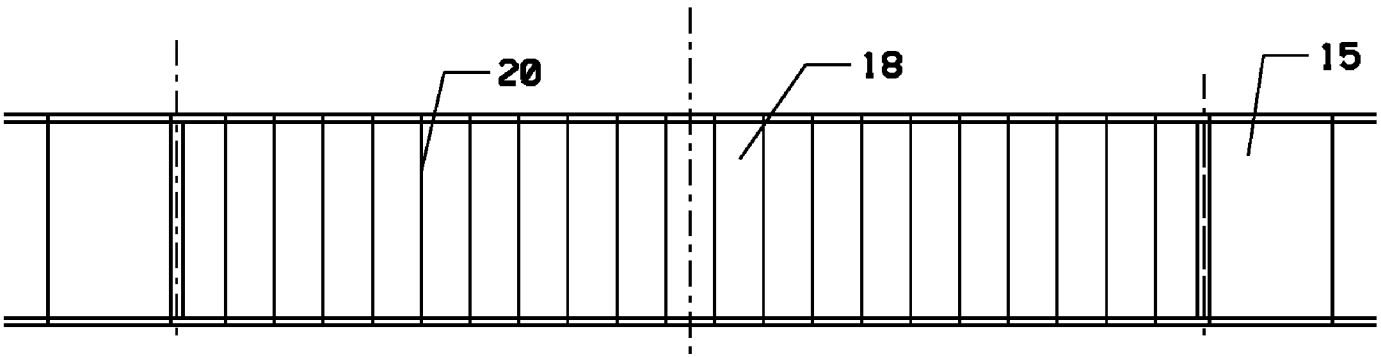
FIG. 2 shows the plan view of the example bridge.
Figure 3:
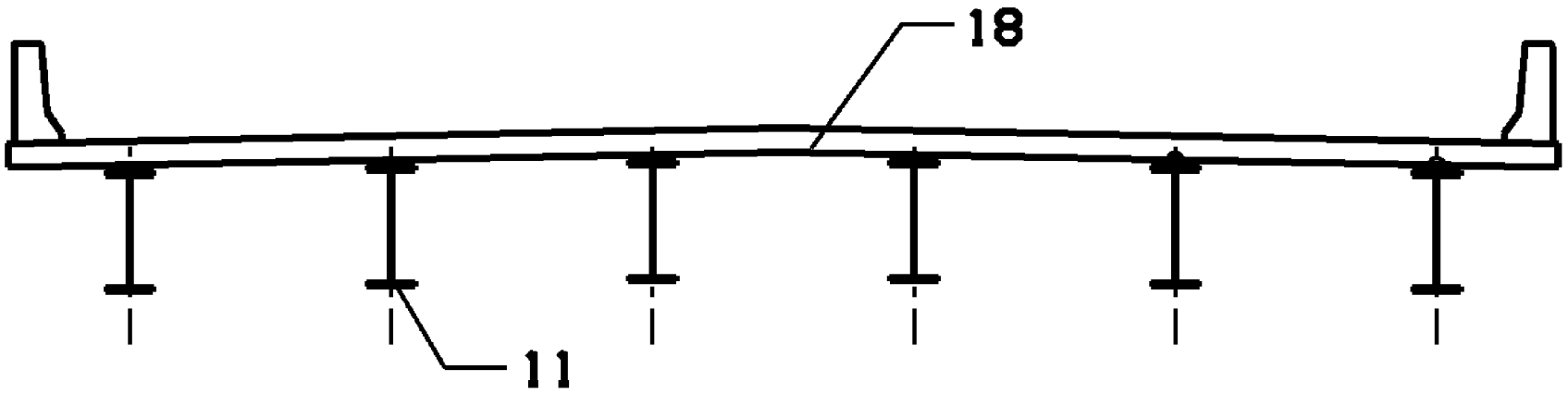
FIG. 3 shows the general cross section of the example bridge
Figure 4:
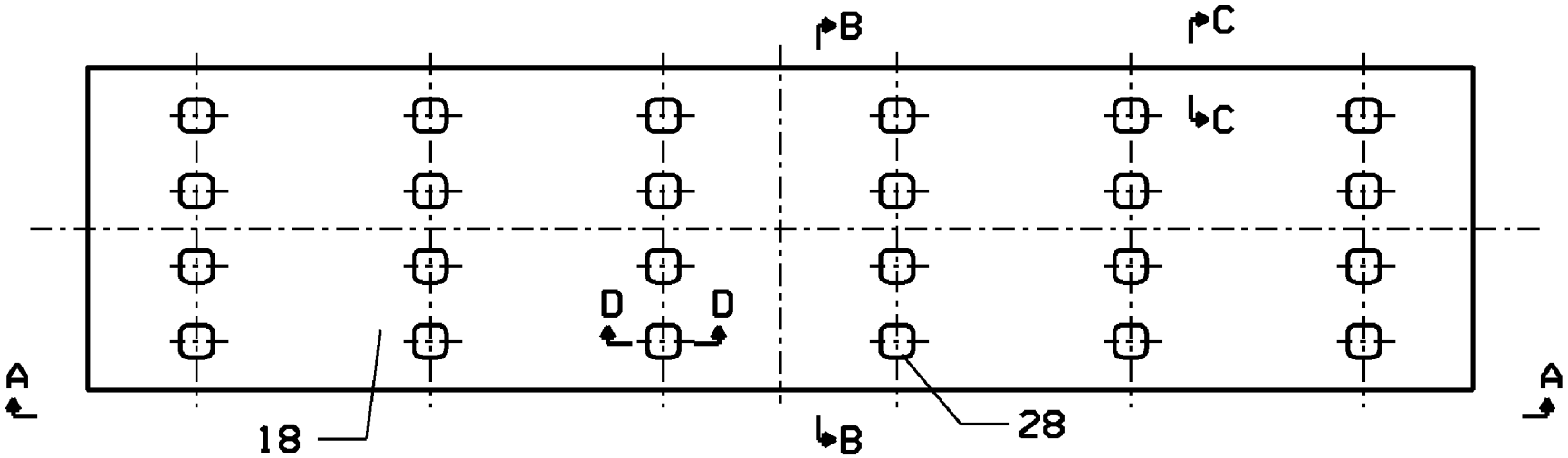
FIG. 4 shows the plan view of a typical deck unit
Figure 4A:
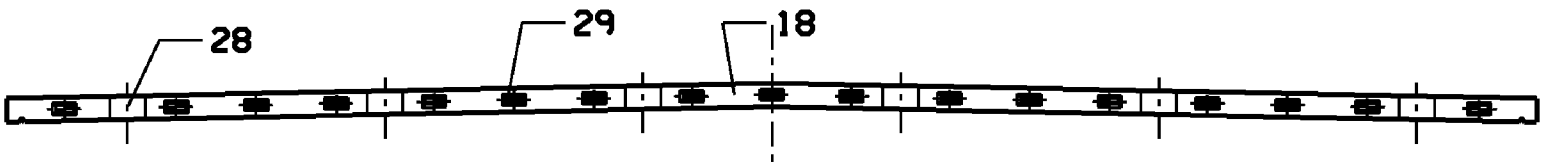
FIG. 4A shows the bulkhead view of a typical deck unit
Figure 4B:
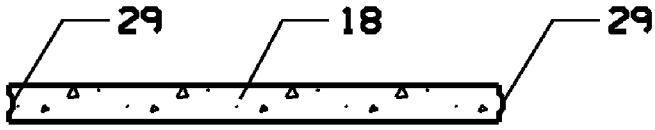
FIG. 4B shows the transverse cross-section of a typical deck unit
Figure 4C:
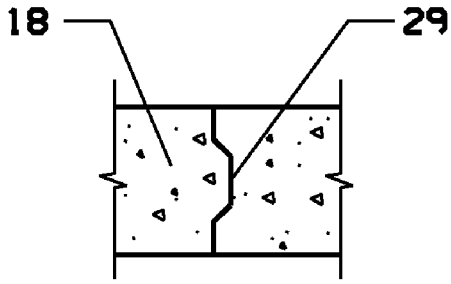
FIG. 4C shows the section of a shear key at a typical deck joint
Figure 4D:
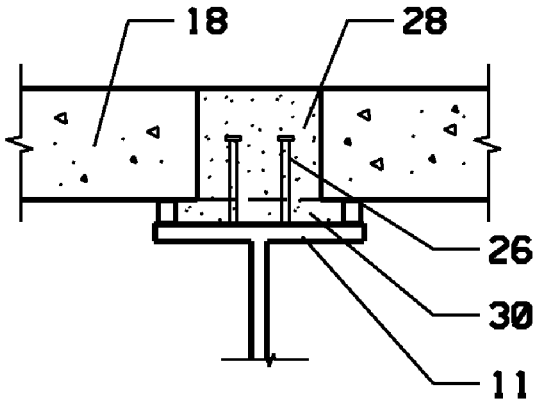
FIG. 4D shows the detail of shear connectors and void for shear connectors

11 girder
12 abutment
13 pier
14 pier diaphragm
15 approach slab
18 precast deck unit
20 joint
26 shear studs
28 void for shear connectors
29 shear keys
30 haunch
31 jacking frame
32 jacks
41 closure pour stage A
42 closure pour stage B
51 bearing stiffener
52 bottom flange bolt connection
53 top flange splice connection
54 high strength filler

DETAILED DESCRIPTION

FIGS. 1 Through 7-Preferred Embodiment

A preferred embodiment of the bridge construction system of the present invention is illustrated in FIGS. 1 through 5 in the context of a two-span bridge, hereinafter referred to as "example bridge". The example bridge has two abutments 12 and a pier 13 acting as substructure units. The preferred embodiment of the bridge construction system is comprised of steel girders 11 acting as longitudinal load-carrying members, precast concrete deck units 18 acting as prefabricated deck units. The precast concrete deck units can be constructed using long or short line match-casting or without match-casting.

However, those features comprising the structural construction system mentioned in the preferred embodiment and the substructure and span arrangement mentioned above can have various embodiments not mentioned in the preferred embodiment, as discussed in detail hereinafter and as will become apparent from a consideration of the ensuing description and drawings.

Steel girders 11 are placed on and supported by abutments 12 and pier 13. Steel girders 11 are of fabricated plate girders, but may be of any suitable structural shape, such as tub girders, rolled beams, trusses, etc. On top of girders 11, a plurality of leveling devices is placed that also allows for relative longitudinal motion between girders 11 and the precast concrete deck units 18. In the preferred embodiment, the leveling devices are comprised of shims, however leveling bolts or other devices that can provide support for the deck and allow for relative longitudinal motion between girders 11 and the precast concrete deck units 18 can be used. As will be evident from the description hereinafter, this allowance for relative motion will allow for the precast concrete deck units to be compressed by reacting to the tensioning of girders 11. Shims may be of steel, plastic, elastomeric materials, teflon-based or teflon-impregnated materials, etc.

A plurality of voids 28, similar to those used in conventional precast deck placement, are provided in deck units 18 above girders 11 to allow for mechanical connection of deck units 18 to girders 11 while shear connectors voids 28 are grouted. Haunches 30 will also be grouted at the same time as the shear connector voids 28. Shear connectors shall be detailed to allow relative motion between precast concrete deck units 18 and girders 11 during the precast concrete deck unit erection process, as hereinafter described. In the preferred embodiment, shear connectors are shear studs 26 welded to the girders 11.

Joints 20 between adjacent precast concrete deck units can be of the match-cast type, with or without epoxy, or cast-in-place using concrete, grout or other suitable jointing materials. In the preferred embodiment, match-cast epoxy joints are used.

Figure 5:
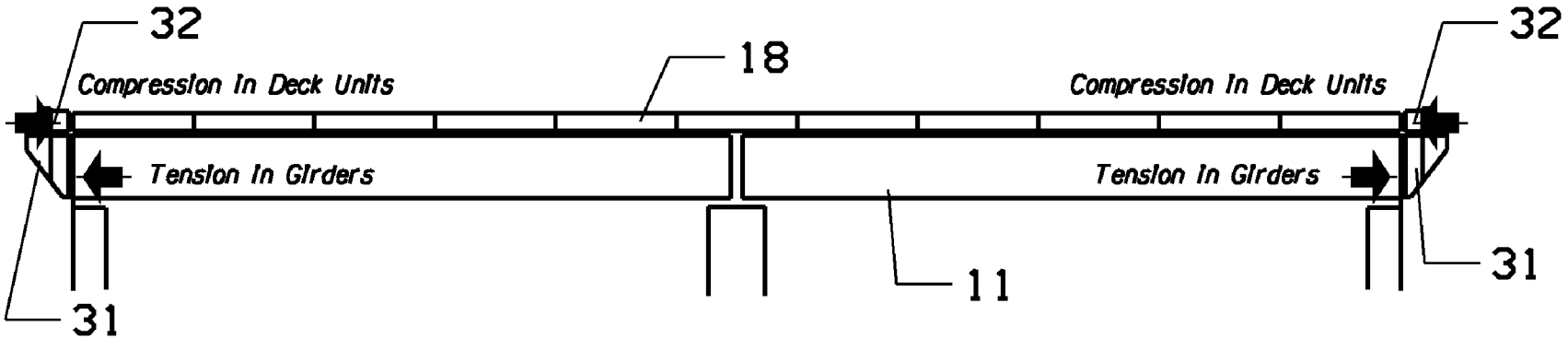
FIG. 5 shows mechanism to apply deck compression force

In the preferred embodiment, jacking frames 31 are connected to the girder at both ends of the bridge, as shown in FIG. 5. Jacks 32 are placed between the jacking frame 31 and the precast deck units 18. However, the deck jacking can also be completed by having only one jacking frame and one jack on one end of the bridge. The last deck unit on the other end of the bridge can be made composite to the girder before the jacking operation so that the end unit can react the deck compression with girder tension.

Figure 7A:
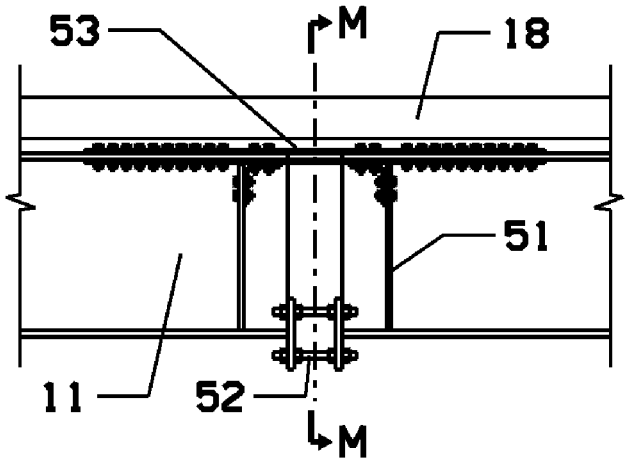
FIGS. 7A-7B show examples of girder connections at the median pier.
Figure 7A:
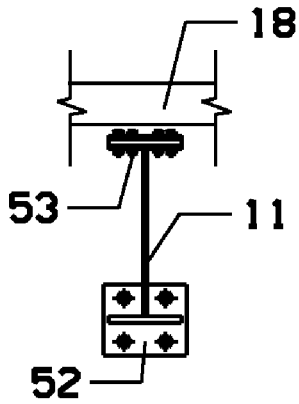
Figure 7B:
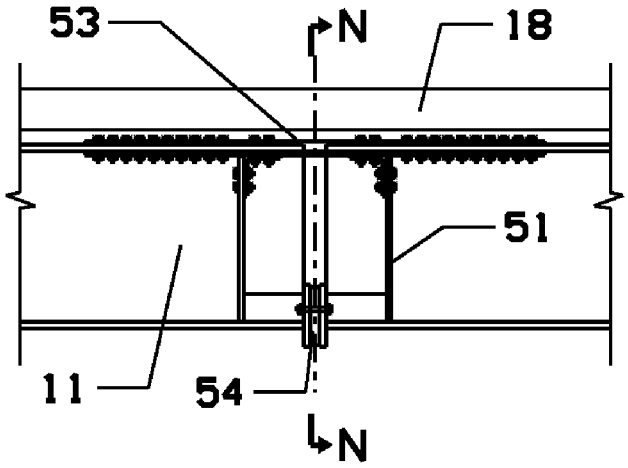
Figure 7B:
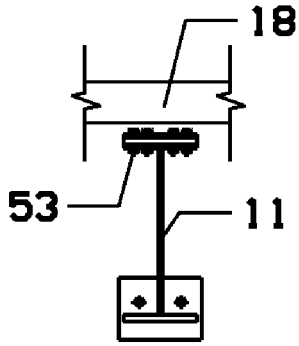

In the preferred embodiment, the girder connection at the pier location is simply supported for dead load and continuous for live load. This is achieved by making the girder bottom flange connection at pier after all dead loads are applied to the structure. FIG. 7A and FIG. 7B show examples of the girder connection at the median pier. Top flange connection 53 is similar to typical steel girder flange splice connection. When only the top flange connection is made, the girder acts as simply supported in bending moment but can transfer axial tension. The girder becomes continuous in transferring moment when both bottom flange and top flange connections are made. FIG. 7A shows a method to connect bottom flanges by bolts 52 and FIG. 7B shows an alternate to connect bottom flanges with high strength filler material 54.

Figure 6A:
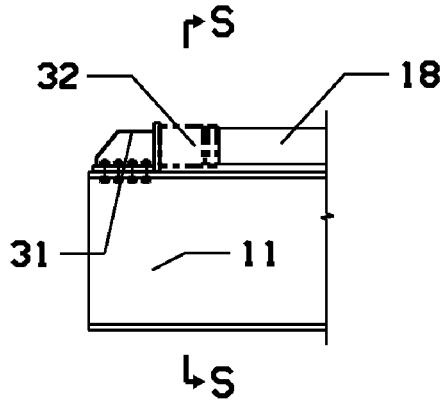
FIGS. 6A-6C show examples of different methods to jack the deck against the girder
Figure 6A:
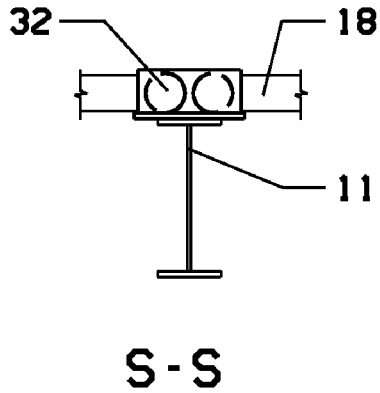
Figure 6B:
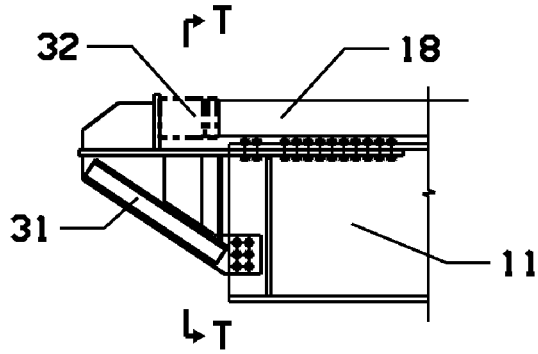
Figure 6B:
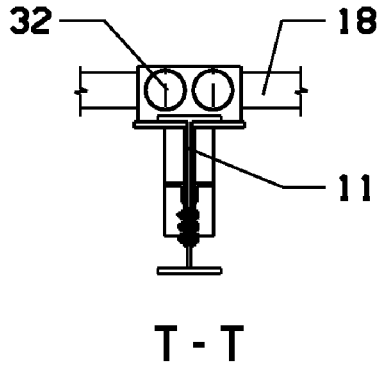
Figure 6C:
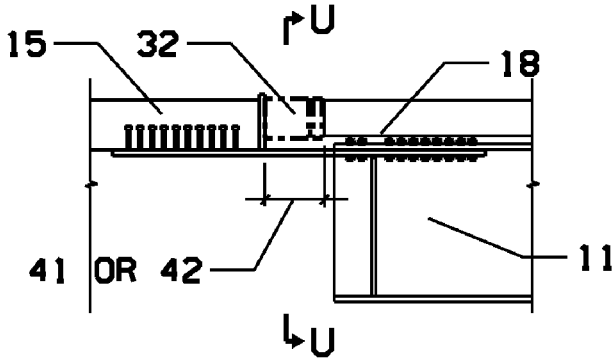
Figure 6C:
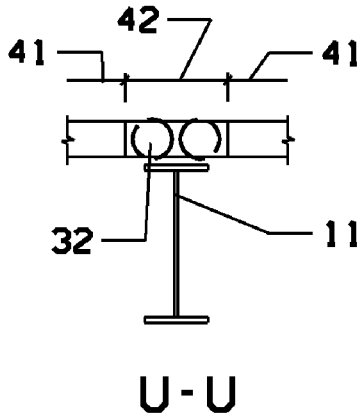

Alternate embodiments for the present invention are described hereinafter:

a. The prefabricated deck units can be comprised of any other material that is suitable for supporting loads anticipated to be applied to the deck units, such as composite material, wood, steel-concrete composite units, etc.

b. The girder layout can be single span or multiple spans. The girder connection type at intermediate piers can be other types, such as simple support for both dead load and live load, or continuous for both dead load and live load.

c. The longitudinal load-carrying members can be comprised of any other material or cross-section suitable to support the loads applied to these members such as steel I-girders, precast prestressed concrete beams, composite material I-girders, single or multiple box girders of steel or concrete, trusses, wood beams, etc.

d. Though the preferred embodiment of the present invention is presented in the context of bridges, it is not limited to bridge applications. Any structural application requiring decking support by longitudinal load-carrying members can utilize the present invention in alternate embodiments such as building floor systems and building roof systems.

e. FIGS. 6A and 6B show two options of jacking frames. Many other methods can also be employed to introducing deck compression by tensioning the girder, and more than one methods can be used in combination in a structure. FIG. 6C shows a method using the bridge approach slab as the jacking diaphragm to apply the jacking force. The approach slab is connected to the girder top flange to provide means to transfer the jacking load. Jacks are placed in the closure between the precast deck and the approach slab. After jacking, jacks are locked and the closure stage A 41 is poured with concrete. After the concrete in closure stage A reaches the appropriate strength, jacks can be removed and closure stage B 42 (blockouts housing the jacks) is grouted or filled with concrete, while all shear connectors voids 28 and haunches 30 of the precast deck units are grouted. A variation to method shown in FIG. 6C is to use the deck end unit, instead of the approach slab, as the jacking diaphragm. At the time of jacking, the deck end unit used as jacking diaphragm is composite with the girder to transfer the jacking force. A minimum of one transverse closure, similar to that of FIG. 6C, is needed to place jacks. The closure construction steps of using a deck end unit as a jacking diaphragm are also similar to these of using an approach slab as a jacking diaphragm. The deck end units can be either precast or cast in place.

f. The present invention can be potentially applied in using precast deck units for deck replacement of existing bridges. The feasibility of this application depends upon whether the girders in the existing bridge can meet the loading during each construction staging, particularly that due to jacking.

g. In the preferred embodiment, the jacking is applied to the entire structure, from one end to the other. A structure can consist of more than one structural unit, where a structural unit is defined as that to which a jacking force can be applied from one end of the structural unit to the other, without applying force to other structural units.

Operation

The preferred embodiment in the context of the example bridge is illustrated hereinafter.

Abutments 12 and pier 13 are constructed. Girders 11 are erected. The top flange connections at the median pier location between girder units are made. The bottom flange connection of girders at the median pier location is not be installed at this time.

The girder top elevation is then surveyed and the shim thickness at each supporting point calculated so as to provide the correct setting elevations for deck units. Shims are placed on top of the girders. Jacking frames 31 are attached to the girder ends.

Precast deck units 18 are erected, placing one unit adjacent to the previously erected one and applying epoxy to the adjacent faces of the two units. Means is employed to provide a certain amount of compression over the epoxy joint (typically at 40 psi, similar to segmental bridge construction) to ensure the joint is properly set. This process is repeated until all deck units 18 are installed.

After all deck units are installed, jacks 32 are placed at the jacking frame 31 locations. Jacks are of types with lock nuts so that the jacking effect can be maintained for an extended period of time without relying on the associated hydraulic or pneumatic system. The jacking operations consist of the following steps:

1. setting all jacks at a small stroke, say ½";
2. install all jacks at the gap between the jacking frames and the precast deck units;
3. shim all jacks tight against the jacking frames and the precast deck units;
4. gradually increase the jacking force to about 5% of the final; stop and check that all jacks and jacking frames are fully engaged;
5. gradually increase the jacking force to about 10% of the final; stop and check that all jacks and jacking frames are fully engaged, lock all jacks at one side of the bridge;
6. continue to increase the jacking load from the opposite side of the bridge;
7. lock all remaining jacks.

After jacking operation, shear connector voids 28 and haunches of the deck connection units 30 are grouted. After grout reaches the design strength, jacks are released and removed. A secondary concrete pour will then be conducted to fill in the closure pour housing the jacks.

The girder bottom flange connection at the median pier is then made at this time so that the girder connection at pier location can function as continuous under live load.

The operational description above is particular to the preferred embodiment of the present invention in the context of the two-span bridge heretofore defined. Alternate materials, member shapes, connection types at the median piers, means of jacking, etc. can be used in employing the structural construction system of the present invention.

The operational sequences described above are for methods using jacking frames similar to these shown in FIG. 6A and FIG. 6B. If other jacking methods are used, the sequences might need to be modified. For instance, when the method shown in FIG. 6C is used, the approach slab and its connection to the girder have to be completed before jacking. If deck end unit is used as the jacking diaphragm, the deck end units must be made composite with the girder before jacking. After jacking, jacks are locked and the closure stage A 41 is filled with concrete. After the concrete in closure stage A reaches the appropriate strength, jacks can be removed and closure stage B 42 (blockouts housing the jacks) is grouted or filled with concrete, while all shear connector voids 28 and haunches 30 of the precast deck units are grouted.

Advantages

The present invention provides a structural system that eliminates many of the drawbacks found in current precast deck construction associated with standard longitudinal post-tensioning. Notably, it offers an alternate to provide pre-compression across joints of precast deck units without employment of post-tensioning tendons or bars and associated ducts. This significantly reduces the cost and time of construction required.

Beyond simply providing a system that eliminates the drawbacks in current precast deck construction, the present invention can potentially increase the load carrying capacity of longitudinal load-carrying members by employing appropriate connection details at the median pier, and correct construction steps. In the preferred embodiment, the jacking introduces a negative moment at the midspan of the girders, which offsets part of the girder moment under service load.

Conclusion, Ramifications, and Scope

In conclusion, the present invention provides a structural construction system utilizing prefabricated deck units that is durable, easy to construct and cost-effective. The present invention can accommodate a variety of structural configurations and can be rapidly constructed.

Although the description above contains many specificities, these should not be construed as limiting the scope of the invention but as merely providing illustrations of some of the presently preferred embodiments of this invention. For example, as illustrated and described herein, the present invention can accommodate a variety of jacking methods and details, a variety of girder connection methods, and a variety of shapes and materials for longitudinal load-carrying members.

Thus the scope of the invention should be determined by the appended claims and their legal equivalents, rather than by the examples given.

I claim:

1. A structural system, comprising:

a. a longitudinal load-carrying member or members, b. a plurality of prefabricated deck units spaced longitudinally along a structure, wherein said prefabricated deck units are supported by said longitudinal load-carrying members, c. at least one set of jacking frames or jacking diaphragms affixed to at least one of said longitudinal load-carrying members, d. jacking means disposed between at least one of said prefabricated deck units and said jacking frames or jacking diaphragms, wherein axial compression force is introduced to a plurality of said prefabricated deck units simultaneously, as longitudinal axial tension is introduced into said longitudinal load-carrying member or members, wherein no separate longitudinal post-tensioning elements are required in the deck.

2. The structural system of claim 1 consists of one or more structural units, wherein the longitudinal axial compression of claim 1 may be introduced into the prefabricated deck units of claim 1 in any one of said structural units independent of any other one or more of said structural units.

3. The structural system of claim 2, wherein longitudinal load-carrying member or members are continuous or partially continuous along each longitudinal line of said longitudinal load-carrying member or members within each structural unit at the time of application of longitudinal tension.

4. The structural system of claim 1, wherein the jacking means is comprised of any one member or any combination of members selected from the group consisting of screw jacks, piston jacks, flat jacks, pancake jacks, hydraulic jacks, pneumatic jacks, and mechanical jacks.

5. The structural system of claim 1, wherein longitudinal load-carrying member or members are comprised of any one member or any combination of members selected from the group consisting of steel, concrete, wood, and composite materials.

6. The structural system of claim 1, wherein longitudinal load-carrying members or member segments are comprised of any one member or any combination of members selected from the group consisting of I-girders, I-beams, box girders, and trusses.

7. The structural system of claim 1, wherein affixed jacking frames or jacking diaphragms are comprised of any one member or any combination of members selected from the group consisting of corbels, brackets, approach slabs, and prefabricated deck units made composite with at least one of said longitudinal load carrying members.

8. The structural system of claim 1, wherein longitudinal load-carrying member or members are comprised of at least one extant and previously in service girder, whereby a deck replacement on an existing bridge superstructure can utilize precast deck units with compression across joints with no need for undesirable internal post-tensioning in said precast deck units.

9. A method for constructing one or more structural units, wherein deck axial compression is not required in the region of a jack or jacks, and wherein no separate longitudinal post-tensioning elements are required in the deck, comprising the steps of:

a. constructing a plurality of prefabricated deck units, a plurality of supports for the structure, and a longitudinal load-carrying member or members, a jack or jacks, and jacking apparatus or apparatuses,
b. installing said longitudinal load-carrying member or members, wherein said longitudinal load-carrying members are supported by said supports
c. making said longitudinal load-carrying member or members continuous or partially continuous throughout said structural unit along each longitudinal line of said load-carrying member or members,
d. installing a plurality of said prefabricated deck units, wherein said prefabricated deck units are supported by said longitudinal load-carrying members and rest on devices that permit relative motion between said prefabricated deck units and said longitudinal load-carrying members,
e. installing a jack or jacks and connecting jacking frames or jacking diaphragms to said longitudinal load-carrying members to transfer the jacking load,
f. using said jack or jacks to introduce axial compression in said prefabricated deck units, wherein said axial compression is simultaneously applied as longitudinal axial tension is applied to said longitudinal load-carrying member or members,
g. making said non-composite prefabricated deck units composite with said longitudinal load-carrying members or member segments,
h. releasing said jack or jacks.

10. The method of claim 9, wherein the supports and the longitudinal load-carrying members support a previously constructed deck that is removed prior to step c of claim 9, whereby a deck replacement operation can utilize precast deck units with compression across joints with no need for undesirable internal post-tensioning in said precast deck units.

11. A method for constructing one or more structural units, wherein deck axial compression is required in the region of a jack or jacks, and wherein no separate longitudinal post-tensioning elements are required in the deck, comprising the steps of:

a. constructing a plurality of prefabricated deck units, a plurality of supports for the structure, and a longitudinal load-carrying member or members, and a jack or jacks,
b. installing said longitudinal load-carrying members, wherein said longitudinal load-carrying members are supported by said supports,
c. making said longitudinal load-carrying member or members continuous or partially continuous throughout said structural unit along each longitudinal line of said load-carrying member or members,
d. installing a plurality of said prefabricated deck units, wherein said prefabricated deck units are supported by said longitudinal load-carrying members and rest on devices that permit relative motion between said prefabricated deck units and said longitudinal load-carrying members,
e. connecting jacking frames or jacking diaphragms to said longitudinal load-carrying member or members to transfer the jacking load, installing a jack or jacks,
f. installing a jack or jacks,
g. using said jack or jacks to introduce axial compression in said prefabricated deck units, wherein said axial compression is simultaneously applied as longitudinal axial tension is applied to said longitudinal load-carrying member or members,
h. placing deck closure material around blockouts for said jack or jacks, whereby compression is applied to said deck closure material upon removal of said jack or jacks, wherein said deck material is supported by said longitudinal load-carrying members and rests on devices that permit relative motion between said deck closure material and said longitudinal load-carrying members,
i. releasing said jack or jacks,
j. making said non-composite prefabricated deck units composite and said deck closure material with said longitudinal load-carrying member or members,
k. filling said blockouts for said jack or jacks with said deck closure material,

12. The method of claim 11, wherein the supports and the longitudinal load-carrying members support a previously constructed deck that is removed prior to step c of claim 11, whereby a deck replacement operation can utilize precast deck units with compression across joints with no need for undesirable internal post-tensioning in said precast deck units.

* * * * *